US010892084B2

(12) United States Patent
Lee

(10) Patent No.: US 10,892,084 B2
(45) Date of Patent: Jan. 12, 2021

(54) ELECTRONIC COMPONENT

(71) Applicant: SAMSUNG ELECTRO-MECHANICS CO., LTD., Suwon-Si (KR)

(72) Inventor: Jae Wook Lee, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 183 days.

(21) Appl. No.: 15/790,748

(22) Filed: Oct. 23, 2017

(65) Prior Publication Data

US 2018/0137965 A1 May 17, 2018

(30) Foreign Application Priority Data

Nov. 15, 2016 (KR) ..... 10-2016-0151999

(51) Int. Cl.

| | |
|---|---|
| ***H01F 27/255*** | (2006.01) |
| ***H01F 17/00*** | (2006.01) |
| ***H01F 27/02*** | (2006.01) |
| ***H01F 27/28*** | (2006.01) |
| ***H01F 41/04*** | (2006.01) |
| *H01F 27/29* | (2006.01) |
| *H01F 17/04* | (2006.01) |

(52) U.S. Cl.

CPC ..... *H01F 27/255* (2013.01); *H01F 17/0013* (2013.01); *H01F 17/0033* (2013.01); *H01F 27/027* (2013.01); *H01F 27/2804* (2013.01); *H01F 41/04* (2013.01); *H01F 27/292* (2013.01); *H01F 2017/048* (2013.01)

(58) Field of Classification Search

CPC .. H01F 27/255; H01F 27/027; H01F 27/2804; H01F 27/292; H01F 17/0013

USPC ..... 336/200, 232

See application file for complete search history.

(56) References Cited

U.S. PATENT DOCUMENTS

| | | | | |
|---|---|---|---|---|
| 6,373,368 | B1 | 4/2002 | Shikama et al. | |
| 2009/0268372 | A1 | 10/2009 | Ogawa et al. | |
| 2010/0289609 | A1* | 11/2010 | Liao | H01F 17/04 336/221 |

(Continued)

FOREIGN PATENT DOCUMENTS

| | | | |
|---|---|---|---|
| CN | 101572185 | A | 11/2009 |
| CN | 105428001 | A | 3/2016 |

(Continued)

OTHER PUBLICATIONS

Office Action issued in corresponding Chinese Application No. 201711126711.3 dated Nov. 15, 2019, with English translation.

*Primary Examiner* — Tszfung J Chan

(74) *Attorney, Agent, or Firm* — Morgan, Lewis & Bockius LLP

(57) ABSTRACT

An electronic component includes: a body including a coil part disposed therein and containing magnetic metal particles; and a surface protection layer disposed on a surface of the body. The magnetic metal particles comprise two or more kinds of particles having different particle sizes from each other, a portion of the magnetic metal particles are exposed to the surface of the body, and uneven regions are formed on the regions of the surfaces of the magnetic metal particles exposed to the surface of the body, and the surface protection layer is in contact with the uneven regions.

15 Claims, 6 Drawing Sheets

(56) References Cited

U.S. PATENT DOCUMENTS

| | | | | |
|---|---|---|---|---|
| 2012/0274432 | A1* | 11/2012 | Jeong | H01F 27/2804 336/192 |
| 2013/0342298 | A1* | 12/2013 | Baba | H01F 1/017 335/302 |
| 2015/0155093 | A1* | 6/2015 | Kim | H01F 17/0013 336/192 |
| 2016/0035476 | A1* | 2/2016 | Mimura | H01F 27/29 336/199 |
| 2016/0086716 | A1 | 3/2016 | Choi et al. | |
| 2016/0172110 | A1* | 6/2016 | Otani | H01G 4/30 361/301.4 |
| 2017/0162319 | A1* | 6/2017 | Otani | H01F 17/0013 |
| 2017/0169930 | A1* | 6/2017 | Kudo | H01F 17/0013 |
| 2018/0247764 | A1* | 8/2018 | Muneuchi | H01F 17/0013 |

FOREIGN PATENT DOCUMENTS

| | | | | | |
|---|---|---|---|---|---|
| JP | 2001-155950 | A | | 6/2001 | |
| JP | 2008-166455 | A | | 7/2008 | |
| JP | 2013-161939 | A | | 8/2013 | |
| JP | 2015065284 | A | * | 4/2015 | H01C 7/008 |
| JP | 2016004814 | A | * | 1/2016 | |
| WO | WO-2017135058 | A1 | * | 8/2017 | H01F 1/20 |

* cited by examiner

ELECTRONIC COMPONENT

CROSS-REFERENCE TO RELATED APPLICATION(S)

This application claims the benefit of priority to Korean Patent Application No. 10-2016-0151999, filed on Nov. 15, 2016 in the Korean Intellectual Property Office, the disclosure of which is incorporated herein by reference in its entirety.

BACKGROUND

1. Field

The present disclosure relates to an electronic component.

2. Description of Related Art

An inductor, which is a type of electronic component, is a representative passive element configuring an electronic circuit together with a resistor and a capacitor to remove noise.

A thin-film type power inductor may be manufactured by forming a coil part by plating, manufacturing a body by curing a magnetic powder-resin composite obtained by mixing a magnetic powder and a resin with each other, and then forming external electrodes on an outer portion of the body.

However, in a case of manufacturing the body using a magnetic metal powder having high conductivity, as described above, when forming the external electrodes on the outer portion of the body and performing nickel plating and tin plating on the external electrodes, plating spread may occur in the body.

In order to prevent a deterioration of reliability caused by the plating spread, a surface protection layer may be coated on a surface of the body. However, since coating efficiency for a magnetic metal is decreased, a plating spread defect problem has not yet been solved.

The reason for the decrease in coating efficiency is that the adhesive property, adhering the coating material of the surface protection layer to the metal, is deteriorated, due to high surface energy caused by intermetallic bonding.

This is to say that, at the time of allowing a liquid-state coating material having a high surface tension to be adsorbed onto a surface of a metal in a solid state, wettability may be deteriorated due to high repulsive force, and thus coating efficiency may be deteriorated.

Therefore, research has been conducted into a method of increasing coating efficiency, to improve a thickness and coverage of a surface protection layer, while preventing plating spread by disposing the surface protection layer on a surface of a body.

SUMMARY

An aspect of the present disclosure may provide an electronic component with improved reliability.

According to an aspect of the present disclosure, an electronic component includes: a body including a coil part disposed therein and containing magnetic metal particles; and a surface protection layer disposed on a surface of the body. The magnetic metal particles comprise two or more kinds of particles having different particle sizes from each other, a portion of the magnetic metal particles are exposed to the surface of the body, and uneven regions are formed on the regions of the surfaces of the magnetic metal particles exposed to the surface of the body, and the surface protection layer is in contact with the uneven regions.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

Electronic Component

Hereinafter, an electronic component according to an exemplary embodiment in the present disclosure, particularly a thin-film type inductor, will be described. However, the electronic component according to the exemplary embodiment is not necessarily limited thereto.

Figure 1:
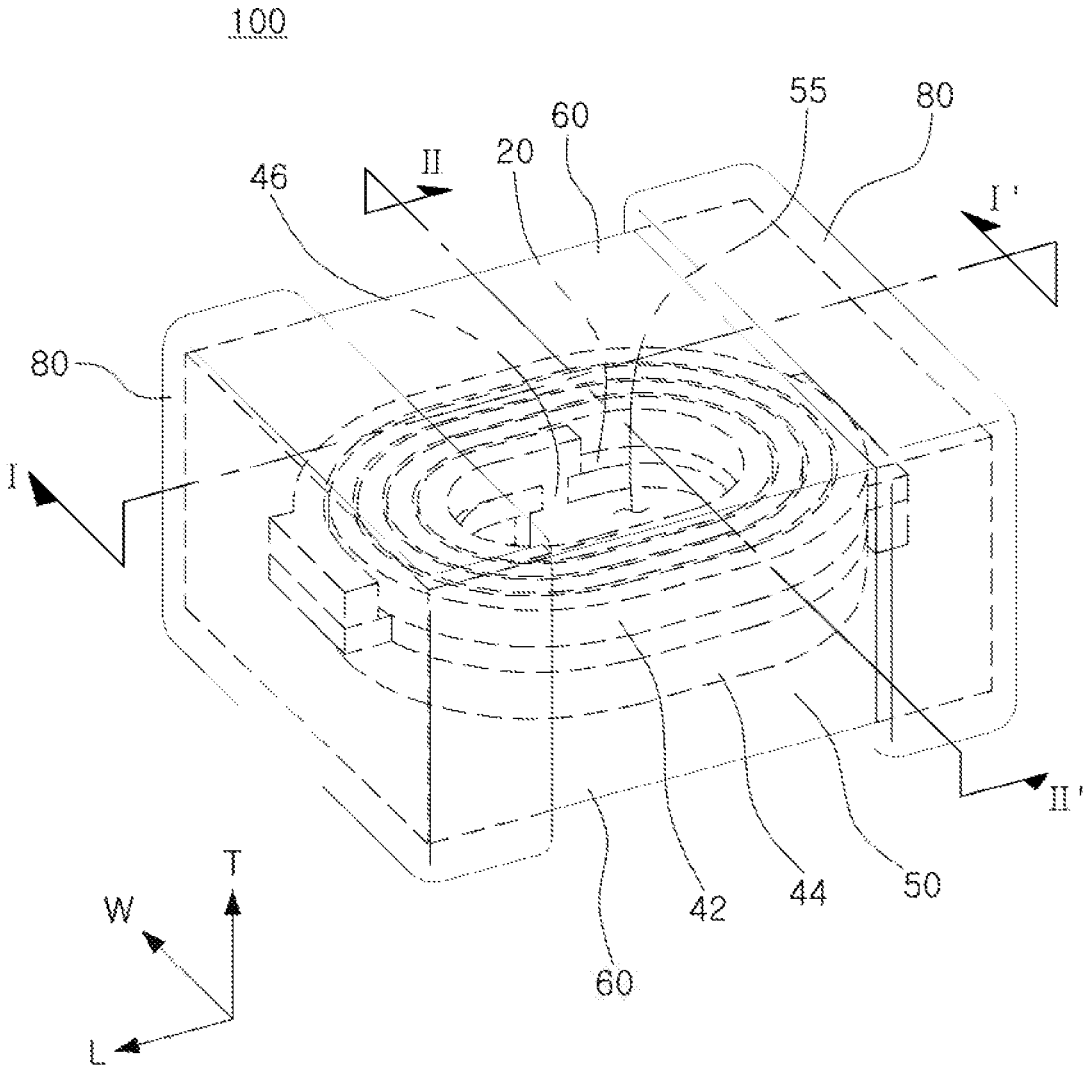
FIG. 1 is a schematic perspective view illustrating an electronic component according to an exemplary embodiment in the present disclosure, so that coil parts thereof are visible.

FIG. 1 is a schematic perspective view illustrating an electronic component according to an exemplary embodiment in the present disclosure, so that coil parts of the electronic component are visible.

Referring to FIG. 1, as an example of the electronic component, a thin-film type inductor 100 used in a power line of a power supply circuit is disclosed.

The electronic component 100, according to the present exemplary embodiment, may include a body 50, coil parts 42 and 44 embedded in the body 50, a surface protection layer 60 disposed on a surface of the body 50, and external electrodes 80 disposed on an outer portion of the body 50, to thereby be electrically connected to the coil parts 42 and 44.

In the electronic component 100 according to the present exemplary embodiment, a 'length' direction refers to an 'L' direction of FIG. 1, a 'width' direction refers to a 'W' direction of FIG. 1, and a 'thickness' direction refers to a 'T' direction of FIG. 1.

Figure 2:
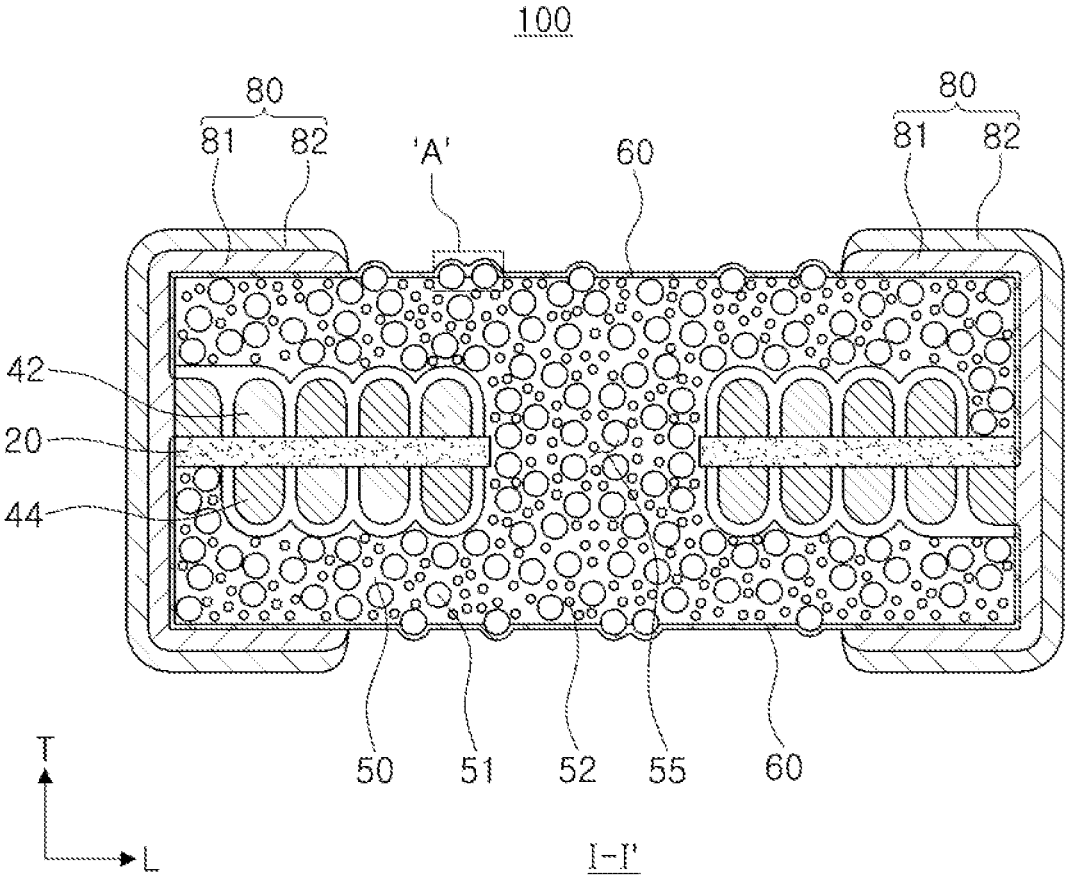
FIG. 2 is a cross-sectional view taken along line I-I' of FIG. 1.
Figure 3:
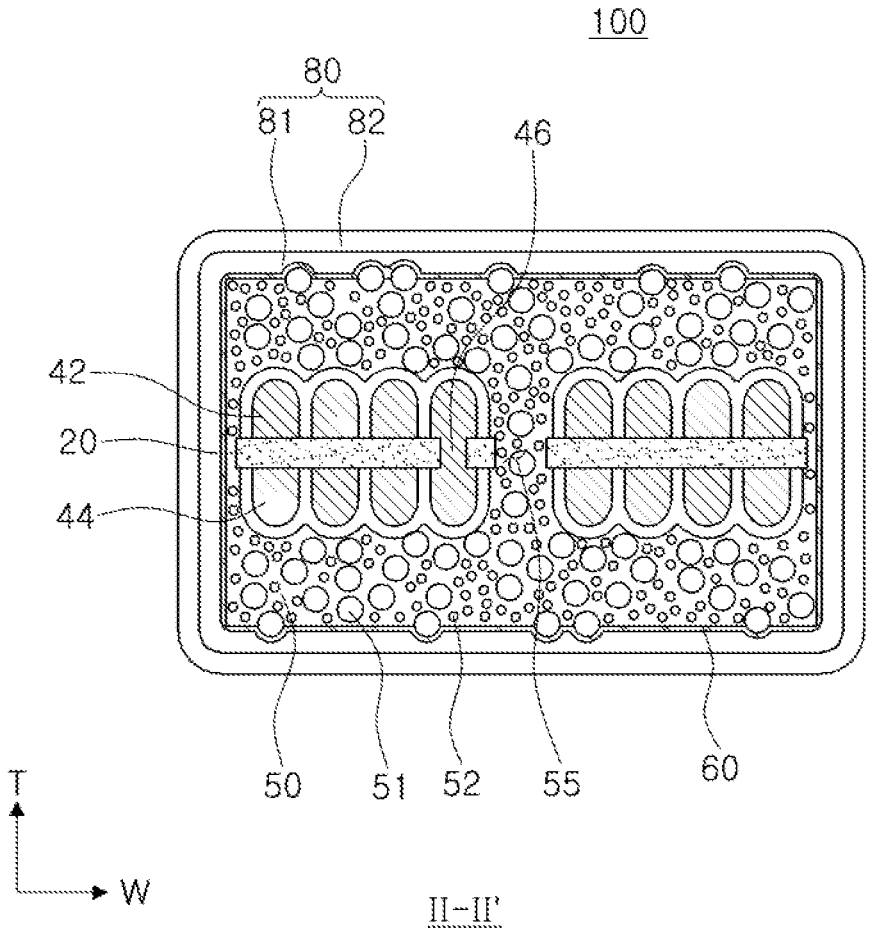
FIG. 3 is a cross-sectional view taken along line II-II' of FIG. 1.

FIG. 2 is a cross-sectional view taken along line I-I' of FIG. 1, and FIG. 3 is a cross-sectional view taken along line II-II' of FIG. 1.

Referring to FIGS. 2 and 3, the body 50 may contain magnetic metal particles 51 and 52.

The magnetic metal particles 51 and 52 may contain any one or more selected from the group consisting of Fe, Si, Cr, Al, and Ni. For example, the magnetic metal particles 51 and 52 may contain a Fe—Si—B—Cr-based amorphous metal, but are not necessarily limited thereto.

The body 50 may further contain a thermosetting resin, and the magnetic metal particles 51 and 52 may be contained in a form in which the magnetic metal particles 51 and 52 are dispersed in the thermosetting resin, such as an epoxy resin, a polyimide resin, or the like.

In order to increase a filling rate of the magnetic metal particles contained in the body 50, at least two kinds of magnetic metal particles 51 and 52 having different particle sizes may be mixed with each other and prepared at a predetermined ratio.

A magnetic metal particle having high magnetic permeability and a large particle size may be used in order to obtain a high degree of inductance at a predetermined unit of volume, and a magnetic metal particle having a small particle size is mixed with the magnetic metal particle having a large particle size, such that high permeability may be secured by improving the filling rate, and deterioration of efficiency due to a core loss at a high frequency and high current may be prevented.

A coil part 42 having a coil shaped pattern may be formed on one surface of an insulating substrate 20 disposed in the body 50, and a coil part 44 having a coil shaped pattern may be formed on the other surface of the insulating substrate 20.

The insulating substrate 20 may be, for example, a polypropylene glycol (PPG) substrate, a ferrite substrate, a metal based soft magnetic substrate, or the like.

A central portion of the insulating substrate 20 may be penetrated to thereby forma hole, and the hole may be filled with the magnetic metal particles, to thereby forma core part 55. As the core part 55 filled with the magnetic metal particles is formed, inductance may be improved.

In the coil parts 42 and 44, a coil pattern may be formed in a spiral shape, and the coil parts 42 and 44, formed on one surface and the other surface of the insulating substrate 20, may be electrically connected to each other through a via 46 formed in the insulating substrate 20.

The coil parts 42 and 44 and the via 46 may be formed of a metal having excellent electrical conductivity. For example, the coil parts 42 and 44 and the via 46 may be formed of silver (Ag), palladium (Pd), aluminum (Al), nickel (Ni), titanium (Ti), gold (Au), copper (Cu), platinum (Pt), an alloy thereof, or the like.

One end portion of the coil part 42 formed on a first surface of the insulating substrate 20 may be exposed to one end surface of the body 50 in the length (L) direction, and one end portion of the coil part 44 formed on a second surface of the insulating substrate 20 opposing the first surface may be exposed to the other end surface of the body 50 in the length (L) direction.

The external electrodes 80 may be formed on both end surfaces of the body 50 in the length (L) direction, so as to be connected to the coil parts 42 and 44 exposed to both end surfaces of the body 50 in the length (L) direction.

As illustrated in FIG. 2, the surface protection layer 60, on the end portions of the coil parts 42 and 44, may be ground and removed so that the end portions of the coil parts 42 and 44 and the external electrodes 80 may be connected to each other.

The external electrodes 80 may include conductive resin layers 81, and plating layers 82 formed on the conductive resin layers 81.

The conductive resin layers 81 may contain any one or more conductive metals selected from the group consisting of copper (Cu), nickel (Ni), and silver (Ag), and a thermosetting resin.

The thermosetting resin contained in the conductive resin layer 81 and the thermosetting resin contained in the body 50 may be the same. For example, the body 50 and the conductive resin layer 81 may contain an epoxy resin.

The body 50 and the conductive resin layer 81 may be formed of the same thermosetting resin as each other, being, for example, the epoxy resin, such that adhesion strength between the body 50 and the external electrode may be improved.

The plating layers 82 may contain any one or more selected from the group consisting of nickel (Ni), copper (Cu), and tin (Sn). For example, nickel (Ni) layers and tin (Sn) layers may be sequentially formed.

At the time of performing the plating, in order to form the plating layers 82, a plating spread defect may occur, in which the plating layer is formed on the magnetic metal particle having a larger particle size and exposed to the surface of the body 50.

Since at the time of grinding a body cut into an individual chip size, the magnetic metal particle having a large particle size may protrude from the surface of the body, and an insulation coating layer in a protruded portion may be delaminated, the plating spread defect described above may occur.

Therefore, at the time of forming plating layers of external electrodes, the plating spread defect, in which the plating layer is formed on a magnetic metal particle of which the insulation coating layer has been delaminated, may occur.

Therefore, according to the present exemplary embodiment, the surface protection layer 60 may be formed on the surface of the body 50. The surface protection layer 60 may cover the magnetic metal particles protruding from the surface of the body, to serve as a plating spread prevention layer.

The surface protection layer and the plating spread prevention layer are thus the same components. Hereinafter, the surface protection layer will be described.

The surface protection layer 60 may contain the same thermosetting resin as the thermosetting resin contained in the body 50.

For example, the magnetic metal particles 51 and 52 may be dispersed in the epoxy resin in the body 50, and the surface protection layer 60 may contain the epoxy resin.

The adhesive force of the surface protection layer 60 may be improved by forming the surface protection layer 60, using the same thermosetting resin as the thermosetting resin contained in the body 50; thus, at the time of performing post-grinding, breakage of the surface protection layer 60 by external impact may be prevented.

Referring to FIGS. 2 and 3, the surface protection layer 60 according to the exemplary embodiment in the present disclosure may be formed on upper and lower surfaces of the body 50, opposing each other in the thickness (T) direction, both side surfaces of the body 50 opposing each other in the width (W) direction, and both end surfaces of the body 50 opposing each other in the length (L) direction.

In this case, the surface protection layer 60, on the end portions of the coil parts 42 and 44, may be ground and removed so that the end portions of the coil parts 42 and 44 and the external electrodes 80 may be connected to each other.

Figure 4:
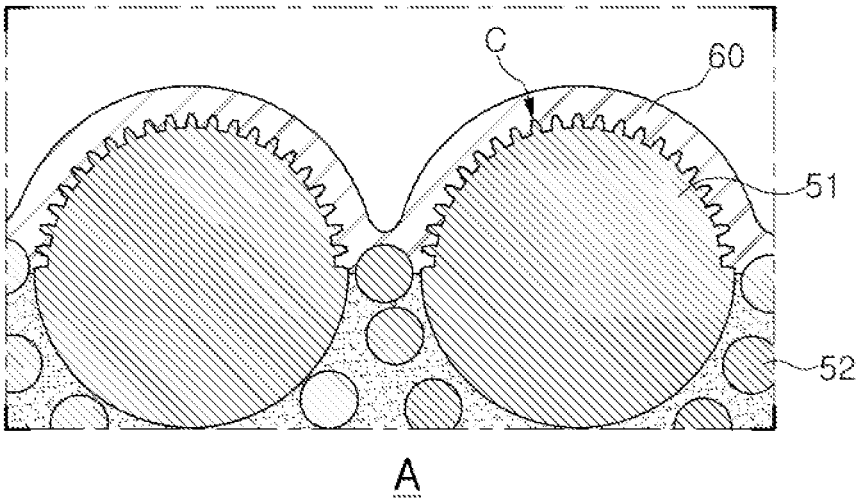
FIG. 4 is an enlarged view of part A of FIG. 2.

FIG. 4 is an enlarged view of part A of FIG. 2.

Referring to FIG. 4, in the electronic component according to the present exemplary embodiment, in some of the magnetic metal particles 51 and 52, some region of each of the particles may be exposed to the surface of the body 50, uneven regions Care formed on surfaces of the magnetic metal particles exposed to the surface of the body 50, and the surface protection layer 60 is in contact with the uneven regions C.

Generally, even though a surface protection layer may be disposed on the surface of the body in order to solve a reliability deterioration problem caused by the plating spread, since coating efficiency of the surface protection layer for a magnetic metal is deteriorated, the plating spread defect problem has not yet been solved.

The reason for the decrease in coating efficiency is that an adhesive property between a coating material of the surface protection layer and the metal is deteriorated due to high surface energy caused by intermetallic bonding.

That is, at the time of allowing a liquid-state coating material having a high surface tension to be adsorbed onto a surface of the metal in a solid state, wettability may be deteriorated due to high repulsive force, and thus, coating efficiency may be deteriorated.

According to the present exemplary embodiment, plating spread prevention efficiency by the surface protection layer 60 disposed on the surface of the body 50 may be improved and coating efficiency may be improved by forming the uneven regions C on the surfaces of the magnetic metal particles 51 and 52 exposed to the surface of the body 50, such that the thickness and coverage of the surface protection layer 60 may be improved.

That is, a coating thickness and coverage of the surface protection layer 60 disposed on the surface of the body 50 may be improved by forming the uneven regions C on the surfaces of the magnetic metal particles 51 and 52 exposed to the surface of the body 50, and thus, an electronic component having excellent reliability may be implemented by decreasing the plating spread defect.

According to the present exemplary embodiment, the uneven regions C may be formed on a surface of a particle having a largest particle size among the magnetic metal particles 51 and 52 exposed to the surface of the body 50, but is not necessarily limited thereto.

As described above, since at the time of grinding the body cut into an individual chip size, the magnetic metal particle having a large particle size may protrude from the surface of the body, and the insulation coating layer in a protruded portion may have been delaminated, the plating spread defect may occur.

Therefore, the surface protection layer 60 may cover the magnetic metal particles protruding from the surface of the body, to serve as the plating spread prevention layer, and in order to increase coating efficiency of the surface protection layer 60, to improve the coverage thereof, the uneven regions C may be formed on the surface of the particle having the largest particle size among the magnetic metal particles 51 and 52 exposed to the surface of the body 50.

Meanwhile, the uneven regions C may be formed on exposed surfaces of the entirety of the magnetic metal particles 51 and 52 exposed to the surface of the body 50.

That is, the uneven regions C may also be formed on the entirety of the magnetic metal particles 51 and 52 exposed to the surface of the body 50, as well as on the particle having the largest particle size among the magnetic metal particles exposed to the surface of the body 50.

In a case of forming the uneven regions C on the entirety of the magnetic metal particles 51 and 52 exposed to the surface of the body 50, as well as on the particle having the largest particle size among the magnetic metal particles 51 and 52 exposed to the surface of the body 50, at the time of allowing a liquid-state coating material having a high surface tension to be adsorbed onto the surface of the metal in a solid state, the problem whereby wettability is deteriorated due to high repulsive force may be solved.

That is, wettability may be improved by forming the uneven regions C on the exposed surfaces of the entirety of metal particles, such that the coating thickness and coverage of the surface protection layer 60 disposed on the surface of the body 50 may be improved.

A method of disposing the surface protection layer 60 on the surface of the body 50 is not particularly limited. For example, the surface protection layer 60 may be disposed on the surface of the body 50 by a coating method.

An average thickness of the surface protection layer 60 may be within a range of 10 μm to 50 μm and, more effectively, within a range of 10 μm to 20 μm.

A stress reduction effect may be excellent by adjusting the average thickness of the surface protection layer 60 to be within a range of 10 μm to 50 μm and, more effectively, within a range of 10 μm to 20 μm.

When the average thickness of the surface protection layer 60 is less than 10 μm, the stress reduction effect may be low, and the magnetic metal particle may be exposed, thereby allowing a plating spread defect to occur.

Meanwhile, when the average thickness is more than 20 μm or 50 μm, since a volume of the body is decreased, in accordance with the average thickness, inductance may be significantly decreased.

The surface protection layer 60 may further contain an insulation filler used in order to impart an insulation property.

The insulation filler may be any one or more selected from the group consisting of silica ($SiO_2$), titanium dioxide ($TiO_2$), alumina, glass, and barium titanate-based powder.

The insulation filler may have a spherical shape, a flake shape, or the like, in order to improve compactness.

The surface protection layer 60 may contain the insulation filler in a content of 100 parts by weight or less, based on 100 parts by weight of the entire thermosetting resin.

A thickness deviation of the surface protection layer 60 may be 2 μm or less.

As the surface protection layer 60 is uniformly formed on the exposed magnetic metal particles, which are coarse particles, as well as on a portion of the surface of the body 50 on which the magnetic metal particles, which are fine particles, and the thermosetting resin are positioned, the thickness deviation of the surface protection layer 60 may be 2 μm or less.

When the thickness deviation of the surface protection layer 60 is more than 2 μm, the magnetic metal particles, which are coarse particles, may be exposed, such that a plating spread defect may occur.

In the present exemplary embodiment, the first magnetic metal particle 51 and the second magnetic metal particle 52, having a $D_{50}$ smaller than that of the first magnetic metal particle 51, may be mixed and contained in the body 50.

The first magnetic metal particle 51, having a larger $D_{50}$, may implement high magnetic permeability, and the first magnetic metal particle 51 having a larger $D_{50}$ and the second magnetic metal particle 52 having a smaller $D_{50}$ may be mixed with each other, such that the filling rate may be improved, thereby further improving permeability and a Q factor.

A $D_{50}$ of the first magnetic metal particle 51 may be within a range of 18 μm to 22 μm, and a $D_{50}$ of the second magnetic metal particle 52 may be within a range of 2 μm to 4 μm.

$D_{50}$ may be measured using a particle diameter and particle size distribution measuring apparatus, using a laser diffraction scattering method.

A particle size of the first magnetic metal particle 51 may be within a range of 11 μm to 53 μm, and a particle size of the second magnetic metal particle 52 may be within a range of 0.5 μm to 6 μm.

The first magnetic metal particle 51 having a larger average particle size, and the second magnetic metal particle having an average particle size smaller than that of the first magnetic metal particle 51, may be mixed and contained in the body 50.

Figure 5:
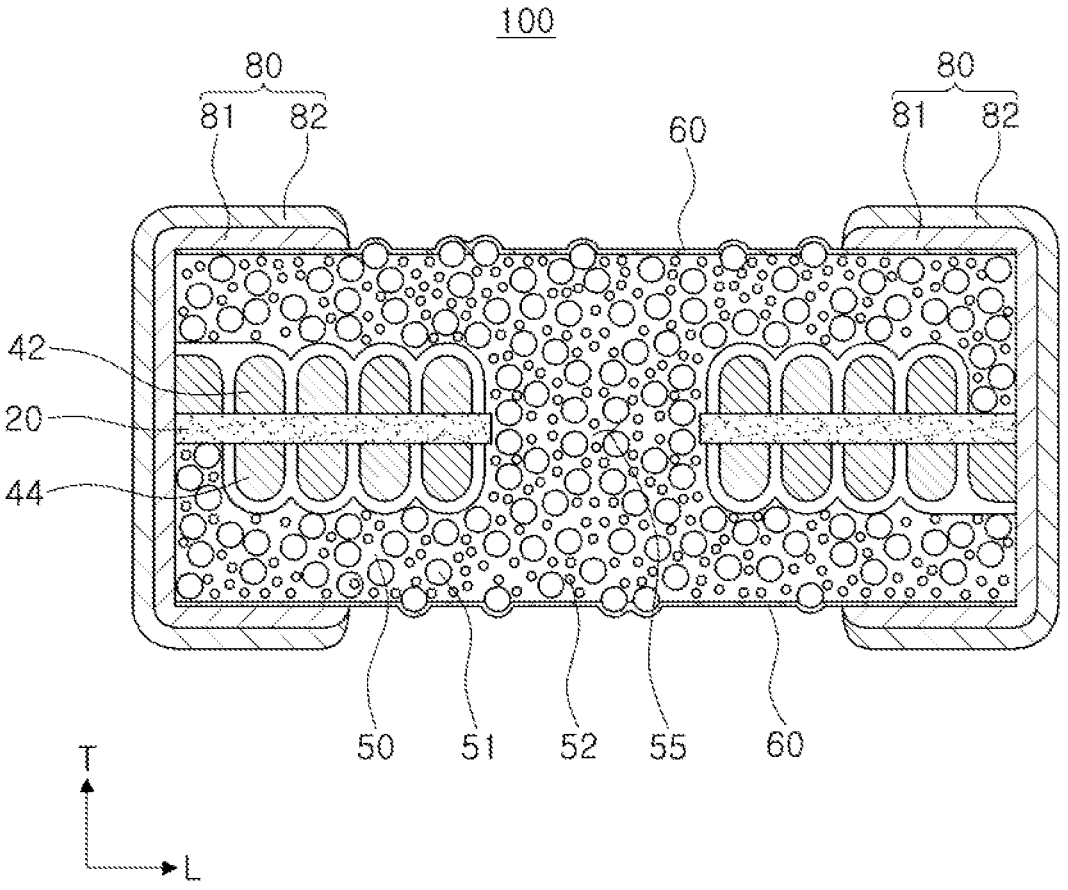
FIG. 5 is a cross-sectional view of an electronic component according to another exemplary embodiment in the present disclosure in an L-T direction.

FIG. 5 is a cross-sectional view of an electronic component, according to another exemplary embodiment in the present disclosure, in an L-T direction.

Referring to FIG. 5, a surface protection layer 60 according to another exemplary embodiment in the present disclosure may be disposed only on the two side surfaces of a body 50 in a width direction and on upper and lower surfaces of the body 50 in a thickness direction.

A plating spread defect occurring due to exposure of magnetic metal particles, which are coarse particles, may occur on the entirety of surfaces of the body, but may mainly occur on the upper and lower surfaces of the body.

Therefore, the surface protection layer 60, to prevent the plating spread defect from occurring, may be formed on the upper and lower surfaces of the body 50.

Further, in a case in which the surface protection layer 60 is disposed only on the two side surfaces of the body 50 in the width direction and the upper and lower surfaces of the body in the thickness direction, according to the present exemplary embodiment in the present disclosure, the surface protection layer 60 may not be disposed on both end surfaces of the body 50 in a length direction, such that a volume of the body 50 may be increased in accordance therewith, thereby increasing inductance.

Figure 6:
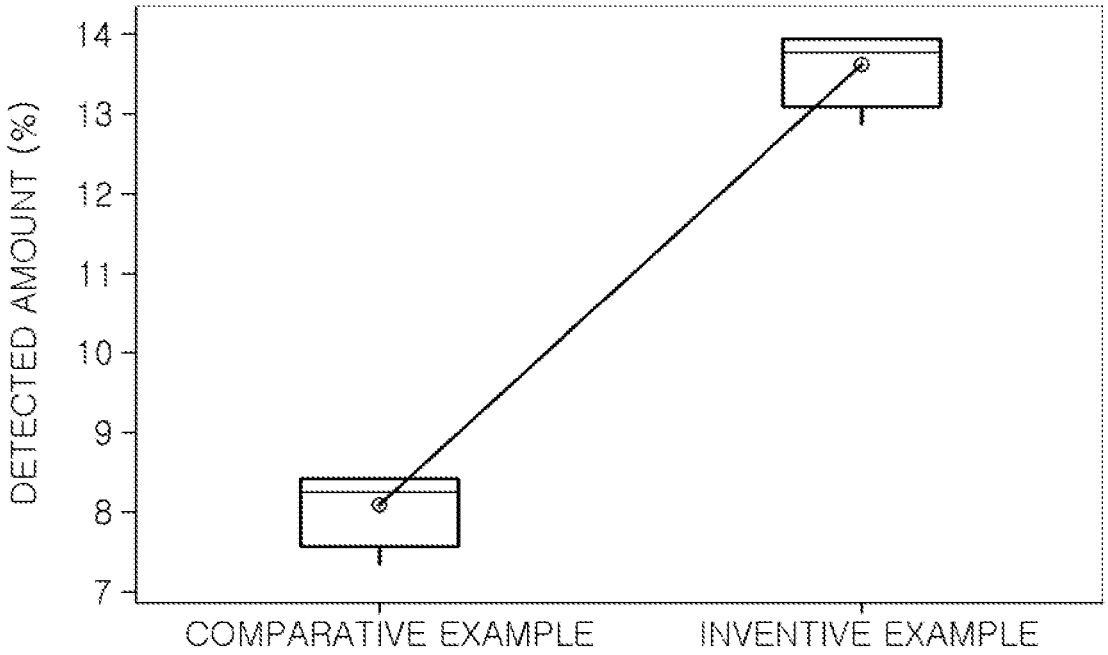
FIG. 6 is a graph comparing detected amounts of a surface protection layer per unit area in an Inventive Example according to the exemplary embodiment in the present disclosure, in which uneven regions are formed on surfaces of the magnetic metal particles exposed to a surface of a body, and on a surface protection layer in a Comparative Example according to the related art.

FIG. 6 is a graph comparing detected amounts of a surface protection layer per unit area in an Inventive Example according to the exemplary embodiment in the present disclosure, in which uneven regions are formed on surfaces of magnetic metal particles exposed to a surface of a body, and a surface protection layer per unit area in a Comparative Example according to the related art.

Referring to FIG. 6, an Inventive Example according to the exemplary embodiment in the present disclosure corresponds to a case in which uneven regions are formed on the surfaces of the magnetic metal particles exposed to the surface of the body, and a Comparative Example according to the related art corresponds to a case in which a surface protection layer is disposed on a surface of a body without forming uneven regions on surfaces of the magnetic metal particles exposed to the surface of the body.

As illustrated in the graph of FIG. 6, it may be appreciated that, in the case in which the uneven regions are formed on the surfaces of the magnetic metal particles exposed to the surface of the body (the Inventive Example according to the present disclosure), a detected amount of a main ingredient of the surface protection layer per unit area of the surface of the body is larger than that in the Comparative Example.

In the Comparative Example, a detected amount of a main ingredient of the surface protection layer per unit area of the surface of the body is about 8 wt % or so, but in the Inventive Example, the detected amount exceeds 13 wt %, such that it may be appreciated that the detected amount in the Inventive Example is larger than that in the Comparative Example.

A method of manufacturing the electronic component according to the exemplary embodiment in the present disclosure may be the same as a method of manufacturing a general electronic component, but since there is a need to form uneven regions on the surfaces of the magnetic metal particles exposed to the surface of the body, an additional process is required.

As a specific method of forming the uneven regions on the surfaces of the magnetic metal particles exposed to the surface of the body, the surfaces of the exposed magnetic metal particles may be ground using a grinding agent.

In more detail, uneven regions may be formed on the surfaces of the magnetic metal particles exposed to the surface of the body by a wet-type grinding method at a low speed using a silicon carbide (SiC) grinding agent.

Except for the description described above, a description of features overlapping those of the above-mentioned electronic component according to an exemplary embodiment in the present disclosure will be omitted.

As set forth above, according to exemplary embodiments in the present disclosure, the coating thickness and the coverage of the surface protection layer disposed on the surface of the body may be improved by forming uneven regions on the surfaces of the magnetic metal particles exposed to the surface of the body of the electronic component.

Therefore, the occurrence of a plating spread defect may be prevented, such that the electronic component having excellent reliability may be implemented.

While exemplary embodiments have been shown and described above, it will be apparent to those skilled in the art that modifications and variations could be made without departing from the scope of the present invention as defined by the appended claims.

What is claimed is:

1. An electronic component comprising:

a body including a coil part disposed therein and containing magnetic metal particles; and an insulative surface protection layer disposed on a surface of the body, wherein the magnetic metal particles comprise two or more kinds of particles having different particle sizes from each other, a portion of the magnetic metal particles are exposed to the surface of the body, and uneven regions are formed on regions of surfaces of the magnetic metal particles exposed to the surface of the body, wherein the uneven regions include a region in which recesses and protrusions are formed, and the insulative surface protection layer is in contact with the uneven regions.

2. The electronic component of claim 1, wherein an uneven region of the uneven region is formed on a surface of a particle having a largest particle size among the magnetic metal particles exposed to the surface of the body.

3. The electronic component of claim 1, wherein the uneven regions are formed on exposed surfaces of an entirety of the magnetic metal particles exposed to the surface of the body.

4. The electronic component of claim 1, wherein an average thickness of the insulative surface protection layer is within a range of 10 μm to 50 μm.

5. The electronic component of claim 4, wherein the average thickness of the insulative surface protection layer is within a range of 10 μm to 20 μm.

6. The electronic component of claim 1, wherein a thickness deviation of the insulative surface protection layer is 2 μm or less.

7. The electronic component of claim 1, wherein the insulative surface protection layer further contains an insulation filler.

8. The electronic component of claim 1, wherein the insulative surface protection layer is disposed on an entire surface of the body.

9. The electronic component of claim 1, wherein the insulative surface protection layer is disposed on both side surfaces of the body in a width direction and upper and lower surfaces of the body in a thickness direction.

10. The electronic component of claim 1, further comprising external electrodes disposed on an outer portion of the body, to be connected to end portions of the coil part, wherein the external electrodes include conductive resin layers and plating layers formed on the conductive resin layers.

11. The electronic component of claim 10, wherein the conductive resin layer contains a conductive metal and a thermosetting resin.

12. The electronic component of claim 10, wherein the plating layer contains any one or more selected from the group consisting of nickel (Ni), copper (Cu), and tin (Sn).

13. The electronic component of claim 10, wherein the insulative surface protection layer is not disposed on both end surfaces of the body in a length direction.

14. The electronic component of claim 1, wherein magnetic metal particles, among the portion of the magnetic metal particles which are exposed to the surface of the body, are spaced apart from each other.

15. The electronic component of claim 1, wherein the uneven regions are formed on the regions of only the surfaces of the magnetic metal particles exposed to the surface of the body.

* * * * *